US012152860B2

(12) United States Patent
Boston et al.

(10) Patent No.: US 12,152,860 B2
(45) Date of Patent: Nov. 26, 2024

(54) GUN SCOPE RELEASE COVER SYSTEM

(71) Applicants: David Boston, Ellwood City, PA (US); David Jones, New Castle, PA (US)

(72) Inventors: David Boston, Ellwood City, PA (US); David Jones, New Castle, PA (US)

( * ) Notice: Subject to any disclaimer, the term of this patent is extended or adjusted under 35 U.S.C. 154(b) by 94 days.

(21) Appl. No.: 18/194,910

(22) Filed: Apr. 3, 2023

(65) Prior Publication Data

US 2024/0328753 A1 Oct. 3, 2024

(51) Int. Cl.
*F41G 1/38* (2006.01)

(52) U.S. Cl.
CPC ..... *F41G 1/383* (2013.01)

(58) Field of Classification Search
CPC ..... F41G 1/383
USPC ..... 42/129
See application file for complete search history.

(56) References Cited

U.S. PATENT DOCUMENTS 2,534,061 A 12/1950 Rogers
2,696,672 A * 12/1954 Durfee ..... F41G 1/383 42/129
2,738,585 A * 3/1956 Vissing ..... G02B 23/16 42/129
2,782,510 A * 2/1957 Kramm ..... G02B 23/16 42/129
2,889,629 A 6/1959 Darkenwald
3,208,146 A * 9/1965 Nelson ..... F41A 35/02 42/129
3,426,433 A * 2/1969 Anderson ..... F41G 1/383 42/129
3,465,446 A * 9/1969 Cox ..... F41G 1/383 42/129
3,496,642 A * 2/1970 Pfahler ..... F41G 1/383 42/129
3,746,423 A * 7/1973 Mills ..... G02B 23/16 42/129
3,831,285 A * 8/1974 Vissing ..... F41G 1/383 42/129
5,365,670 A * 11/1994 Klimochko ..... F41G 1/38 42/129
5,566,490 A * 10/1996 Owen ..... F41G 1/383 42/129
7,685,760 B1 * 3/2010 Neumaster ..... F41G 1/473 42/129
2010/0037506 A1 * 2/2010 Carley ..... F41G 1/383 42/129
2017/0299334 A1 * 10/2017 Hamilton ..... F41G 3/08
2021/0071991 A1 * 3/2021 Jones ..... F41G 1/383
2022/0074707 A1 * 3/2022 Dunning ..... F41G 1/383
2024/0027168 A1 * 1/2024 Havens ..... F41G 1/383

FOREIGN PATENT DOCUMENTS

GB 2547935 A * 9/2017 ..... F41A 35/02

* cited by examiner

*Primary Examiner* — Samir Abdosh
(74) *Attorney, Agent, or Firm* — Harpman & Harpman

(57) ABSTRACT

A dual release gun scope cover system for use with a gun scope having an eye piece end and a front objective lens end. The gun scope cover system has a cylindrical eye piece engagement mount with a lens cover and a cylindrical front end engagement mount with a lens cover. The lens covers are retained in closed position on the respective scope engagement mounts by magnetic attraction to a control action rod extending there between for simultaneous release and gun scope use.

15 Claims, 5 Drawing Sheets

GUN SCOPE RELEASE COVER SYSTEM

BACKGROUND OF THE INVENTION

1. Technical Field

This invention relates to telescopic gun scopes, specifically to gun scope lens covers that overlie the respective ends of a gun scope protecting it prior to use.

2. Description of Prior Art

Prior art gun scope caps and covers are used on telescopic rifle scopes that are positioned on top of a rifle having an elongated tube with a plurality of magnifying objective lenses positioned therein for providing an enlarged view of a distance target. It is critical that the lenses in the respective scope ends be protected when not in use. Cover or lens caps have been developed to selectively fit on the scope ends and may be hinged so as to afford ease and quickness of scope use when they are removed.

Examples of dual gun scope lens caps and methods of operating them can be seen in U.S. Pat. Nos. 2,534,061, 2,696,672, 2,738,585, 2,889,629 and 3,496,643.

U.S. Pat. No. 2,534,061 discloses a telescopic site lens cover having a pair of lens caps interconnected by a release bar. Each cap is split with independent hinges and has a spring hinge release by a sliding lever.

U.S. Pat. No. 2,696,672 claims a snap action protection cover for the ends of a telescopic site allowing for instantaneous removal using an elastic band in communication with the respective end cover.

U.S. Pat. No. 2,738,585 illustrates a telescopic scope lens cover device having a pair of hinged covers over the respective ends of a scope with an activation rod and a release button allowing the covers to open.

U.S. Pat. No. 2,889,629 describes an eye piece cover for a gun scope with independent spring hinges which are released and flip open allowing for user visual access.

U.S. Pat. No. 3,496,642 claims a gun scope cover with a dual quick release having an elastic cord between the end covers providing constant resilient pressure when in a hinged closed position. A center release cord activates a sliding latch releasing the cover by the resilient engagement of the cord.

SUMMARY OF THE INVENTION

A dual release gun scope lens cover system having an interconnected pair of hinge spring urged lens scope covers each with an integrated magnet for magnetic alignment with a corresponding magnetic enabled retainment and release rod movable from a magnetic attraction retainment cap cover closed position to a magnetic opposing release cover open position simultaneously by manual engagement of an offset rod crank for axial rotation input thereto.

DETAILED DESCRIPTION OF THE INVENTION

Figure 1:
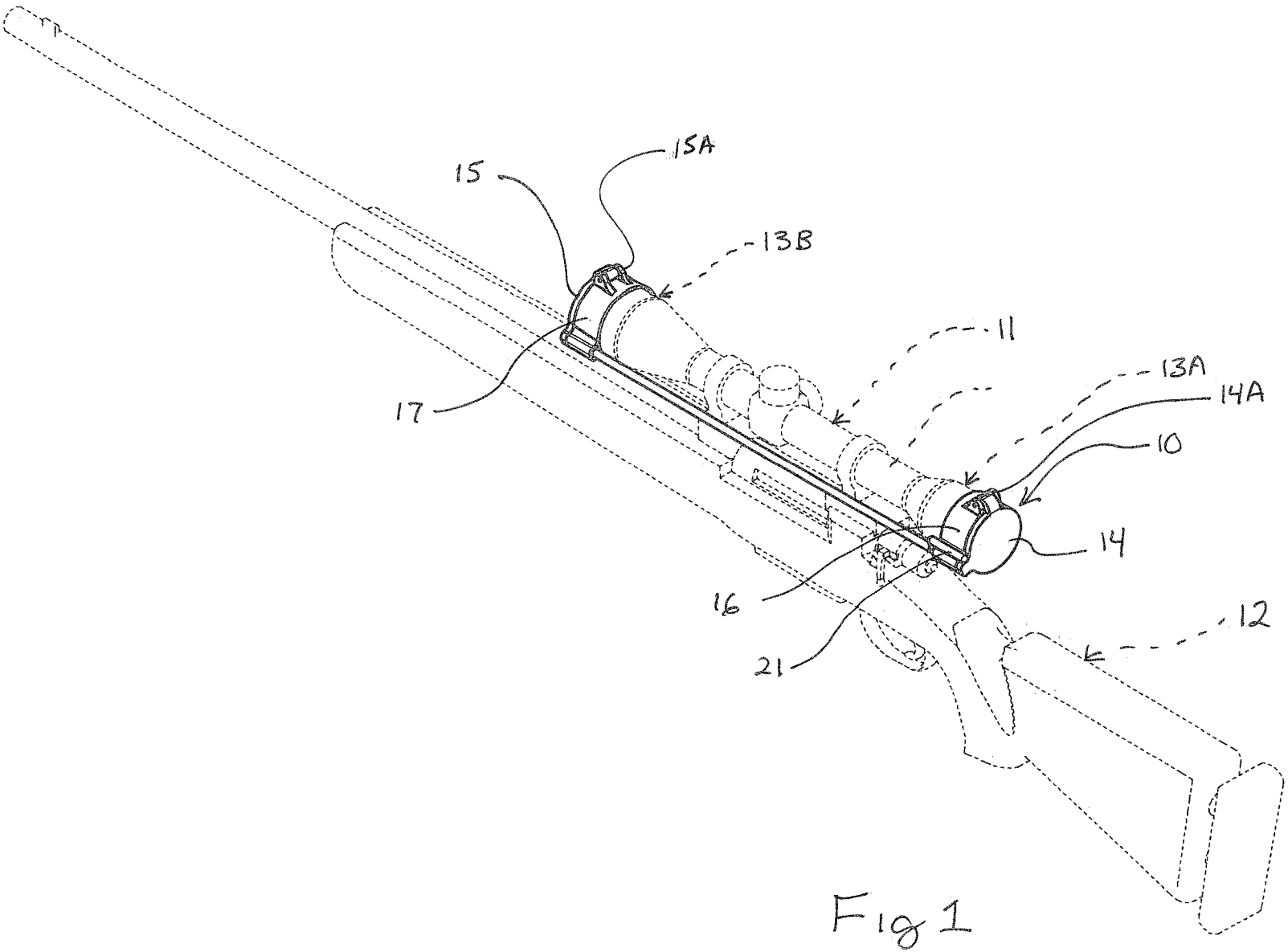
FIG. 1 is a perspective view of the gun scope lens cover system on a gun scope mounted on a rifle shown in broken lines.
Figure 9:
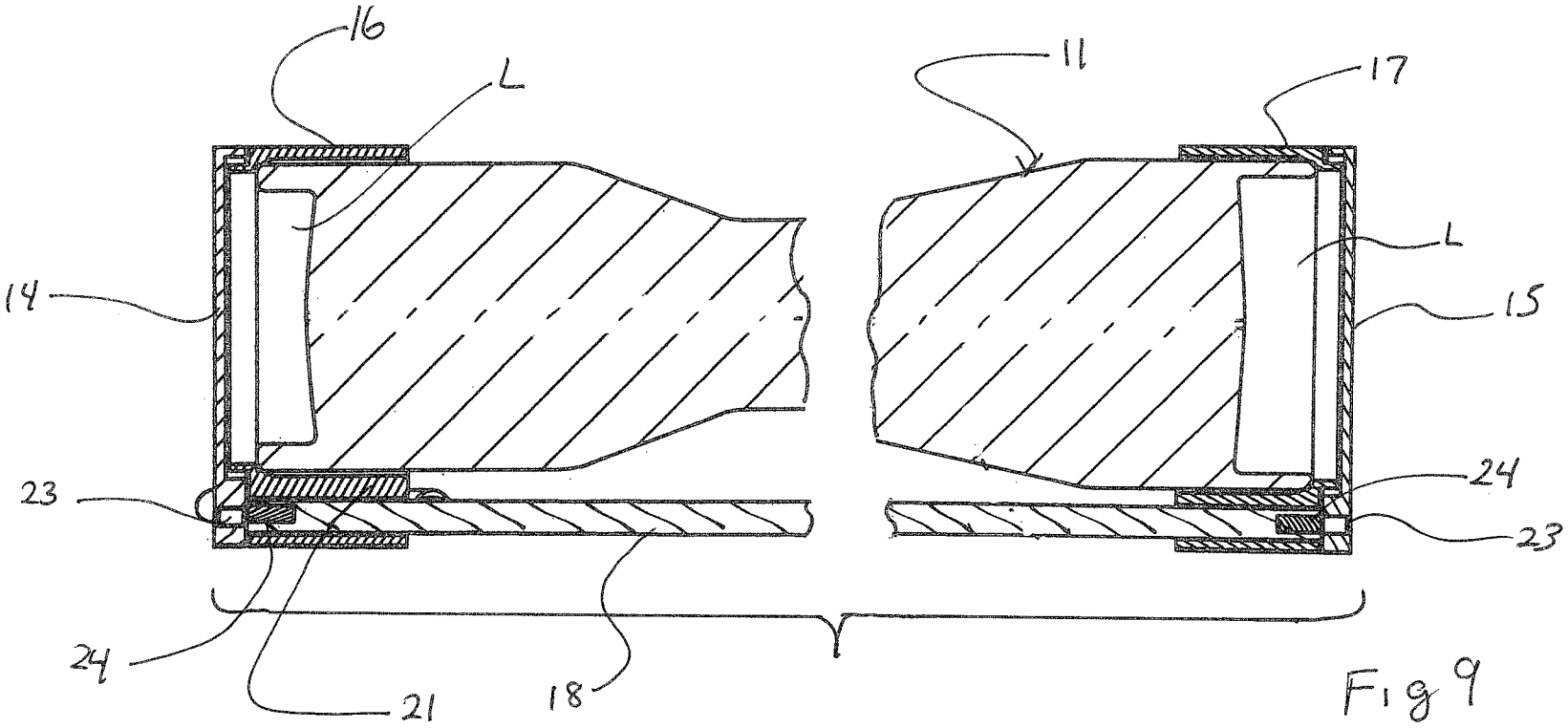
FIG. 9 is a partial side sectional view of the end lens cover system of the invention on a gun scope with portions broken away for illustration sectional lines.

Referring to FIG. 1 of the drawings, a gun scope lens cover assembly 10 of the invention can be seen on a gun scope 11 mounted on a rifle 12 shown in broken lines for illustration. The gun scope 11 includes a contoured cylindrical tubular body 13 with an eye piece end 13A and a front end 13B. The gun scope 11 has internal magnification lenses L as seen for illustration purposes in FIG. 9 of the drawings that allow for siting of the rifle on distant targets, not shown, as will be understood by those skilled in the art.

The gun scope lens cover assembly 10 has an eye piece lens cover 14 and a front-end cover 15 which are hinged at 14A and 15A to respective cylindrical eye piece mounting member 16 and end mounting member 17 on the respective eye piece and front ends 13A and 14A of the gun scope 11.

The hinge fittings 14A and 15A extend from the corresponding cylindrical mounting members 16 and 17 so as to allow rotation of the respective lens covers 180 degrees to afford the user, not shown, to fully see the scope field when in operation as seen in FIGS. 4-7 of the drawings. The respective hinge fittings 14A and 15A are spring hinges with a spring resistant element therein as is known in the art.

The mounting members 16 and 17 are coupled together by an activation control rod 18 that is registerably received in apertures 19 in the respective mounting members 16 and 17. The receiving apertures 19 are formed in lug portions 20 extending from the respective mounting members 16 and 17 providing longitudinal support and rotational retainment thereof.

Figure 7:
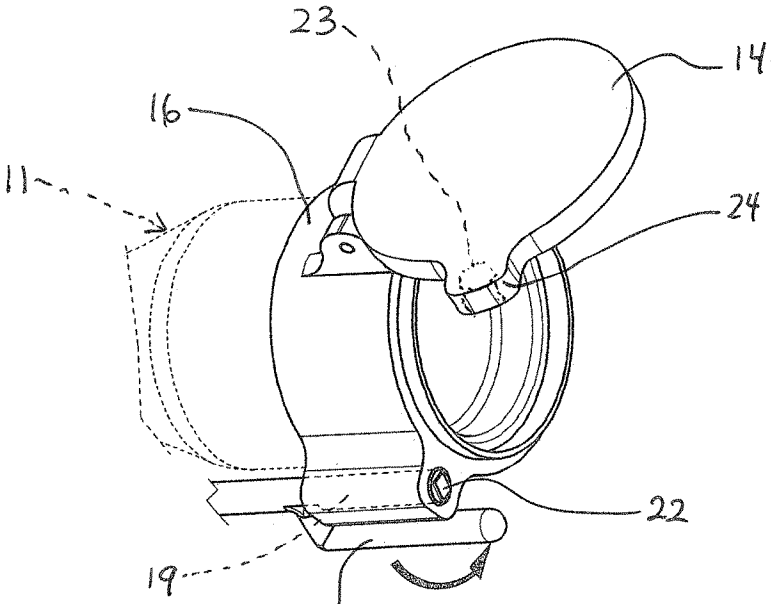
FIG. 7 is an enlarged partial perspective side, top and end view of the lens cover in open position with magnetic control activation arm lever illustrated in deployment rotational position thereto.

The control and activation rod 18 has an offset lever arm 21 that extends in spaced parallel longitudinal relation to the apertured lug portions 20, best seen in FIG. 7 of the drawings. The activation and control rod 18 is axially rotatable by the lever arm 21 as indicated by directional arrow A.

Figure 2:
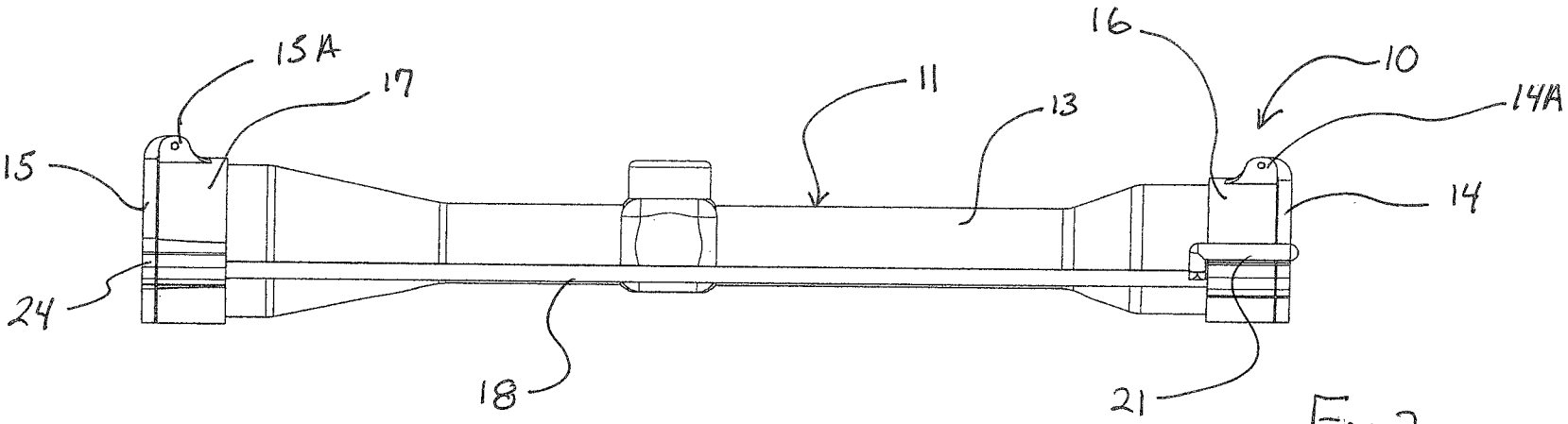
FIG. 2 is a side elevational view of the gun scope lens cover of the invention with the lens covers in closed position.
Figure 3:
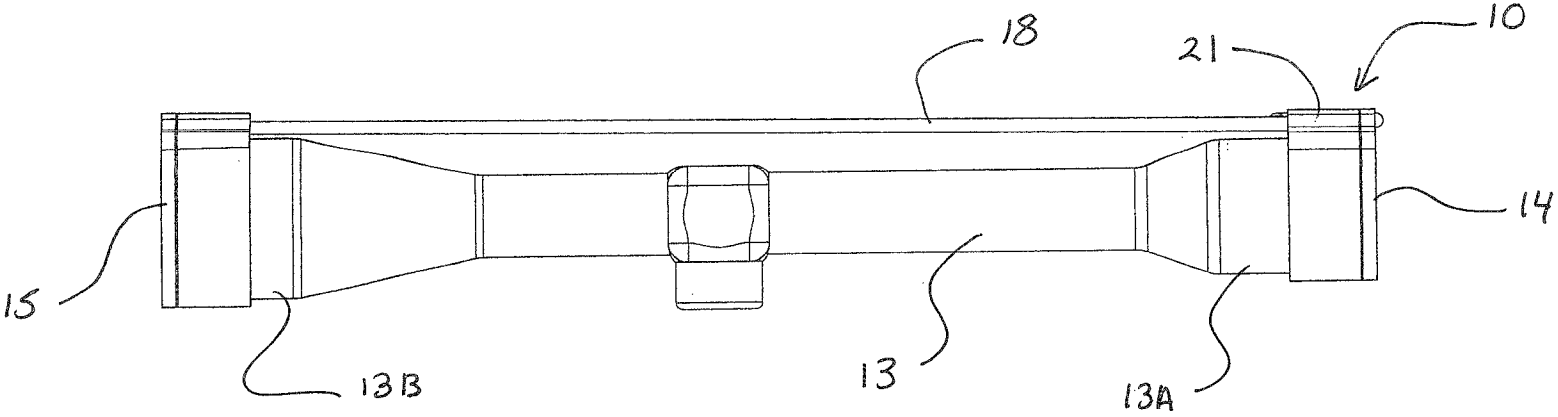
FIG. 3 is a bottom plan view thereof.
Figure 4:
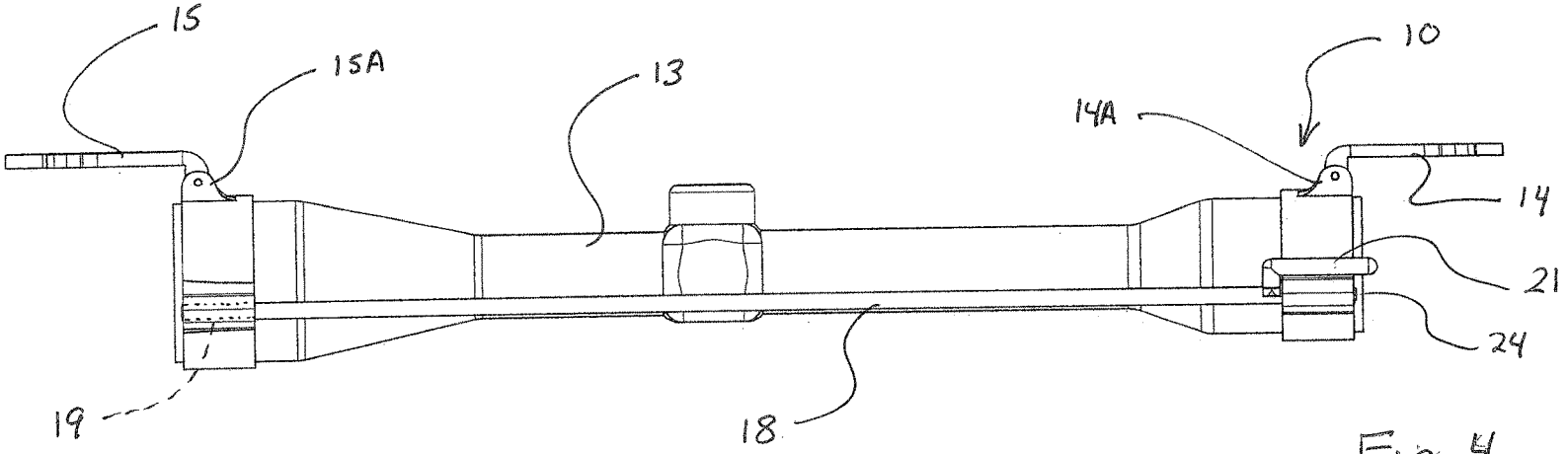
FIG. 4 is a side elevational view of the gun scope cover of the invention in open position.
Figure 5:
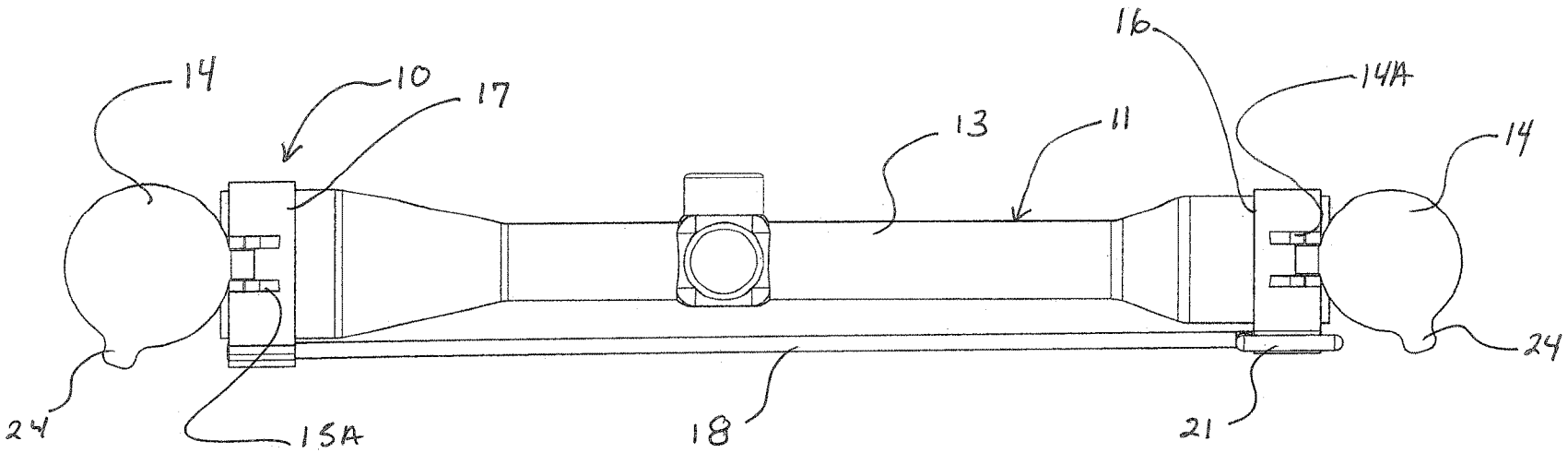
FIG. 5 is a top plan view thereof.
Figure 6:
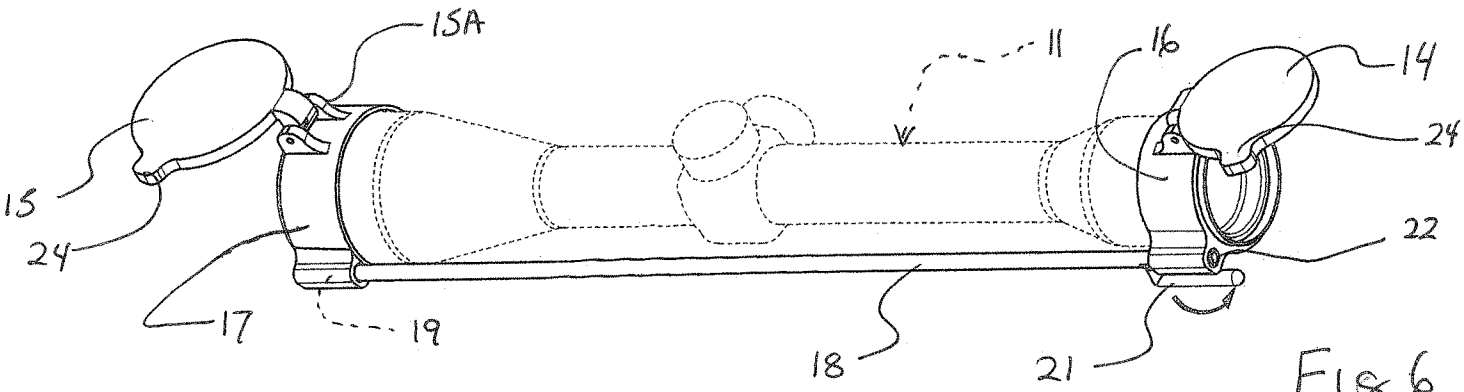
FIG. 6 is a perspective view thereof with the gun scope shown in broken lines.

Magnets 22 are positioned in both free ends of the rod 18 defining the magnetic pole thereof. Correspondingly, magnets 23 are positioned in respective apertured tabs 24 on the respective covers 14 and 15 in alignment with the rod end magnets 24 when in closed position illustrated in FIGS. 1-3 of the drawings.

It will be evident therefore that the magnetic pairs 23 are used to hold the lens caps 14 and 15 by magnetic attraction in closed position on the gun scope ends 13A and 13B and correspondingly to release the lens covers 14 and 15 under their spring urged hinge 14A and 15A to rotate to open viewing position of the scope as seen in FIGS. 4-7 of the drawings.

The release of the magnetic attraction of the opposing magnetic poles N pole to S south pole for the attraction force of magnets is defines as magnetism and the space around the magnets is defined as magnetic field within the art.

It will therefore be seen that by aligning the respective magnetic poles and the magnetic field in attraction, N pole to S pole, or repulsing N pole to north and S pole to south, and effective positional retainment or release of the lens cap covers 14 and 15 can be achieved through the activation and control rod 18.

Figure 8:
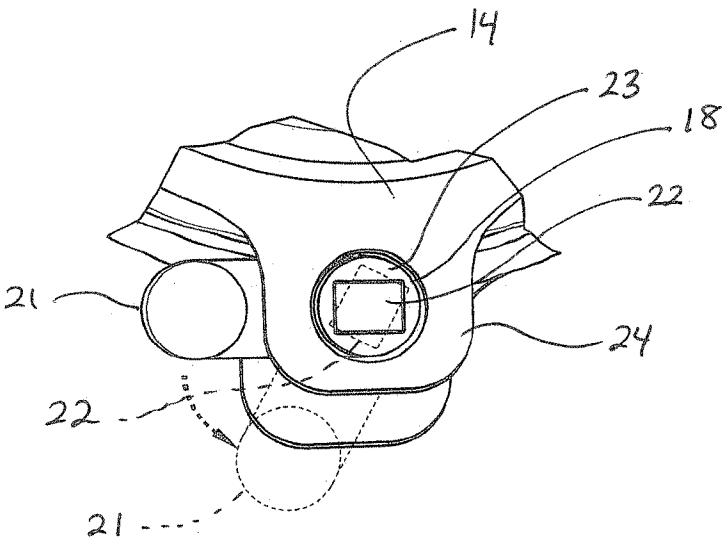
FIG. 8 is an enlarged partial end view of the magnetic control activation rod end with the magnet's engagement orientation in solid and broken lines.

Given that the orientation of the magnetic field is fixed in the lens cover, positioned magnets 23, the rotation of the magnets 24 in the respective rod 18 ends, as hereinbefore described, affords the change in attraction to repulsion indicated in FIG. 8 of the drawings wherein the end magnet orientation is illustrated in solid to broken lines in response to rod 18 rotation by the hereinbefore described lever arm 21 shown in broken lines.

It will be seen that in operation the gun scope lens cover assembly 10 provides initial closed end cover position held in place by the magnetic attraction achieved by the respective rod end magnets 24 and cover magnets 23 orientation as seen in FIGS. 1-3 and 9 of the drawings. The lever arm 21 positioned by the eye piece scope end 13A can easily be engaged by the user, not shown, with one hand thereby rotating the rod 18 so as to realign the magnetic poles position simultaneously for both the lens covers releasing the lens covers 14 and 15 which, as noted, spring open allowing viewing access positioned, as hereinbefore described shown in FIGS. 6 and 7 of the drawings. The rod 18 may be spring loaded to permit the lever arm 21 to rotate back to its pre-engagement position so that the respective covers 14 and 15 may be independently re-engaged and held in closed position.

It will thus be seen that a new and novel gun scope cap assembly gun cover assembly 10 of the invention has been illustrated and described and it will be apparent to those skilled in the art that various changes and modification may be made thereto without departing from the spirit of the invention.

Therefore, We claim:

1. A gun scope cover system for use with a gun scope having an eye piece end and a front end comprising;

an eye piece cylindrical mounting member having an open center for seating around said eye piece end of said gun scope, and an eye piece cover that is rotatably coupled to the cylindrical eye piece mounting member by a hinge to cover the eye piece end of the gun scope;

a front cylindrical mounting member having an open center for seating around the front end of said gun scope and a front cover that is hinged to the cylindrical mounting member to cover the eye piece end of the gun scope;

a connecting rod coupled between the eye piece mounting member and the front mounting member, said connecting rod operatively connected to the eye piece cover and front cover, said connecting rod including magnetic ends having a north pole magnet and a south pole magnet on said respective oppositely disposed free ends, and the eye piece cover and front cover having a magnetic magnet coupled thereto having a north pole end and an oppositely disposed south pole end respectively for mating with said respective magnets of the connecting rod ends, wherein axial movement of the connecting rod opens the eye piece cover and the front cover substantially simultaneously into open position.

2. The gun scope cover system of claim 1 further comprising a spring coupled to the hinge of the eye piece cover and a spring coupled to the hinge of the front cover, wherein each of the springs normally urge the associated cover into open position.

3. The gun scope cover system of claim 1, further comprising an extension on the eye piece cylindrical mounting member and extension coupled to the front mounting member, each extension including a recess for receiving an end of the connecting rod with the connecting rod having ends and which each end being positioned in one of the recesses of the extensions.

4. The gun scope cover system set forth in claim 3 wherein said respective elongated extensions are in longitudinal alignment with one another and on said respective mounting members in parallel relation to the longitudinal axis of the gun scope.

5. The gun scope cover system set forth in claim 1 wherein the eye piece cover and the front cover are disk like with an annular periphery.

6. The gun scope cover system set forth in claim 1 wherein the magnets on the connecting rod respective ends are in reverse polarity when the connecting rod is actually rotated to release the connecting rod magnets from the cover magnets magnetic attraction.

7. The gun scope cover set forth in claim 1 wherein the connecting rod includes a parallel offset lever arm for connecting rod axial rotation thereby.

8. A scope cover system for use with an optical scope having an eye piece end and a front end comprising;

an eye piece cylindrical mounting member having an open center for seating around said eye piece end of said optical scope, and an eye piece cover that is rotatably coupled to the cylindrical eye piece mounting member by a hinge to cover the eye piece end of the optical scope;

a front cylindrical mounting member having an open center for seating around the front end of said optical scope and a front cover that is hinged to the cylindrical mounting member to cover the eye piece end of the optical scope;

a connecting member coupled between the eye piece mounting member and the front mounting member, said connecting member operatively connected to the eye piece cover and front cover, said connecting member including magnetic ends having a magnet north pole and a magnet south pole on respective oppositely disposed free ends, and the eye piece cover and front cover having a magnetic magnet coupled thereto having a magnet north pole end and an oppositely disposed magnet south pole end respectively for mating with said respective magnets of the connecting member ends, wherein axial movement of the connecting member opens the eye piece cover and the front cover substantially simultaneously into open position by reversing magnet poles on said member.

9. The scope cover system of claim 8 further comprising a spring coupled to the hinge of the eye piece cover and a spring coupled to the hinge of the front cover, wherein each of the springs normally urge the associated cover into open position.

10. The scope cover system of claim 8, further comprising an extension on the eye piece cylindrical mounting member and extension coupled to the front mounting member, each extension including a recess for receiving an end of the connecting member with the connecting member having ends and which each end being positioned in one of the recesses of the extensions.

11. The scope cover system of claim 8 wherein said connecting member is a rod.

12. The scope cover system set forth in claim 10 wherein said respective elongated extensions are in longitudinal alignment with one another and on said respective mounting members in parallel relation to the longitudinal axis of the scope.

13. The scope cover system set forth in claim 8 wherein the eye piece cover and the front cover are disk like with an annular periphery.

14. The scope cover system set forth in claim 11 wherein the magnets on the connecting member respective ends are in reverse polarity when the connecting rod is actually rotated to release the connecting rod magnets from the cover magnets magnetic attraction.

15. The scope cover set forth in claim 11 wherein the connecting rod includes a parallel offset lever arm for connecting rod axial rotation thereby.

* * * * *